US005931446A

United States Patent [19]

Vandelinde

[11] Patent Number: 5,931,446

[45] Date of Patent: Aug. 3, 1999

[54] POLE JACK APPARATUS

[75] Inventor: Henry Vandelinde, Queensville, Canada

[73] Assignee: Winsafe Corp., Markham, Canada

[21] Appl. No.: 08/851,857

[22] Filed: May 6, 1997

[51] Int. Cl.[6] ..... B66F 1/04

[52] U.S. Cl. ..... 254/108

[58] Field of Search ..... 254/108, 109, 254/110, 111; 182/136

[56] References Cited

U.S. PATENT DOCUMENTS 4,382,488 5/1983 Anderson .
4,463,828 8/1984 Anderson .
4,597,471 7/1986 Anderson .

*Primary Examiner*—David A. Scherbel
*Assistant Examiner*—Benjamin Halpern
*Attorney, Agent, or Firm*—Arne I. Fors

[57] ABSTRACT

A pole jack apparatus for travelling up and down a pole including a frame member with a jacking mechanism. A pump lever is utilized for causing the jacking mechanism to engage the pole for upward and downward travel. The jacking mechanism includes an interlock device to ensure that one of two engagement pins is engaged with the pole at all times. A separate spring biased, "dead man" brake is also provided for added safety.

11 Claims, 10 Drawing Sheets

FIG.6.
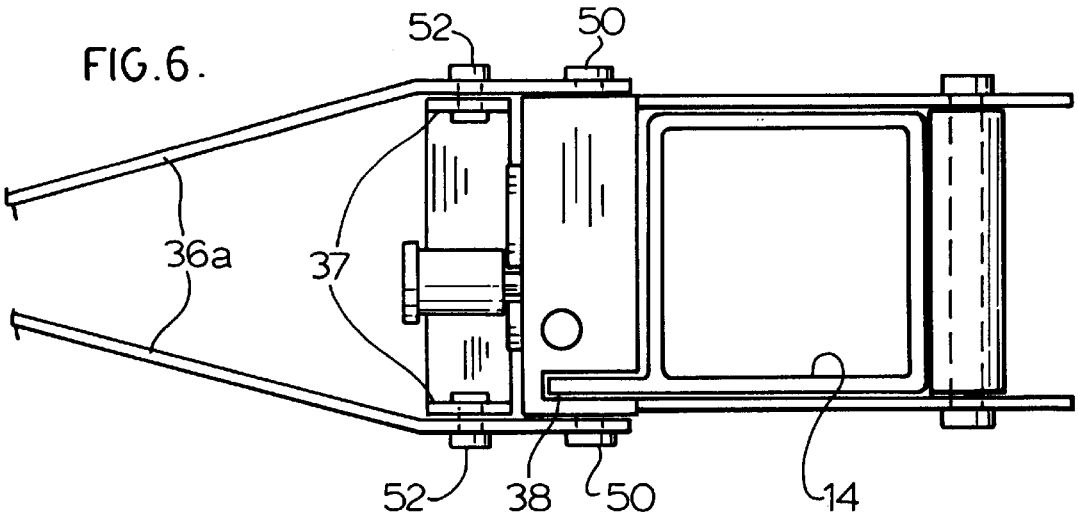
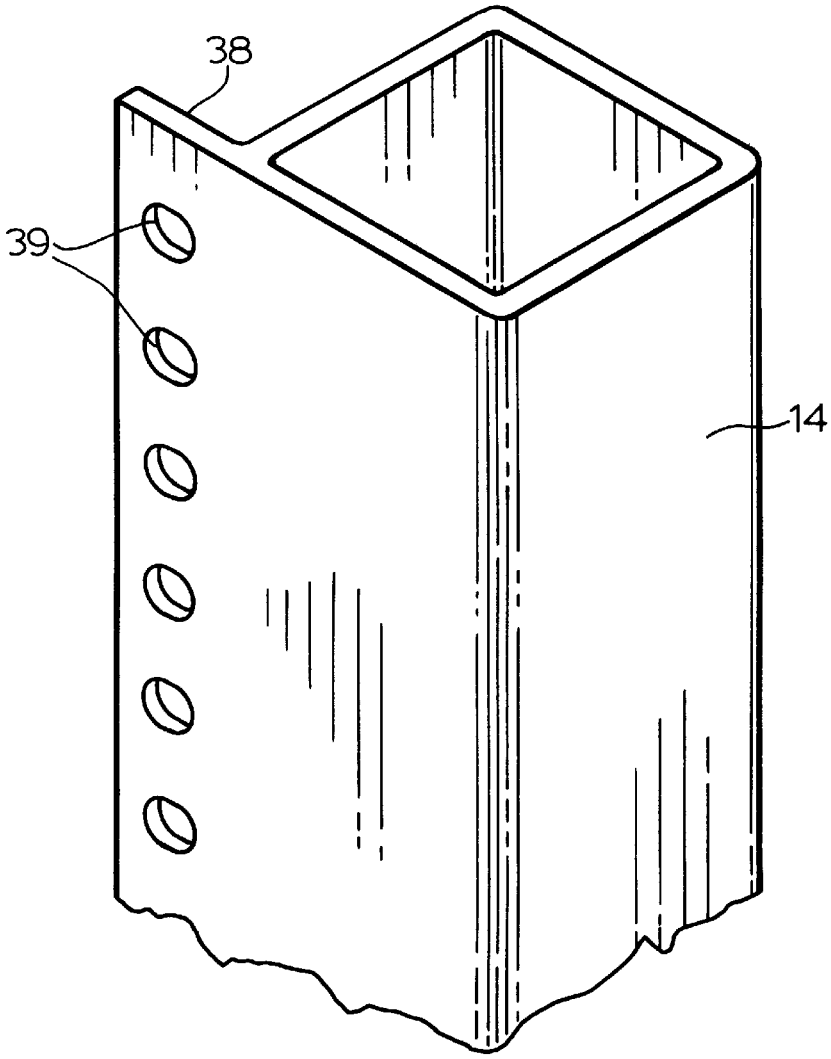
FIG.5.

POLE JACK APPARATUS

BACKGROUND OF INVENTION (i) Field of the Invention

This invention relates to scaffolding systems, and more particularly to a pole jack for travelling up and down a pole for supporting a scaffold.

(ii) Description of the Related Art

In numerous industries, it is necessary to erect scaffolding both for internal use as well as for external use in order to permit workers to stand at an elevation above ground surface. Typically, by way of example, a scaffolding system is utilized in the installation of aluminum siding on the exterior of housing. Such scaffolding is conventionally erected by utilizing pump jack poles which are spaced apart and secured in spaced relationship to a house by means of braces. Pump jacks are used to ride up and down the poles. The pump jacks typically include support arms on which are extended scaffold staging. The workers can stand on the scaffold staging and operate the pump jacks to move the staging up and down along the pump jack poles.

U.S. Pat. No. 4,597,471 discloses a heavy duty pump jack which includes a frame with upper and lower shackle members supported by the frame. A pump arm is pivotally provided on the frame and operates the shackles in alternating relationship. The pump arm serves to position the upper shackle in a twist gripping securing relationship on the pole while it then serves to raise the frame stepwise upwardly along the pole. The weight of the jack then shifts so that the lower shackle twist grips the pole and the upper shackle steps up to a next position on the pole. In this manner, the non-gripping shackle steps up the pole while the opposing shackle grips the pole. To ride the pump jack down the pole, the lower shackle is released from its gripping relationship and the upper shackle is rolled down the pole by means of a handle.

U.S. Pat. No. 4,382,488 describes a pump jack pole formed of elongated hollow metal with a rubberized surface on one side of the pole. Such poles were found to be strong, long lasting and easier to manipulate than the standard wooden poles. U.S. Pat. No. 4,463,828 and aforementioned U.S. Pat. No. 4,597,471 describe improved pump jacks which include features to improve the safety of the pump jack as well as its strength. Such features include the ability to release one of the shackles by means of a foot release pedal, thereby avoiding the necessity of bending over and releasing the lower shackle by hand. It is also known to employ an over-the-center spring loaded handle to control the rolling down of the pump jack.

The aforementioned features provided in pump jacks have served to improve the operation and safety of such pump jacks in the industry. Nevertheless, additional safety measures are always warranted with respect to this type of scaffold system. For example, the known spiral rod utilized to control rolling down of the pump jack along the pump jack pole has a tendency to wear, thereby causing accidental sliding of the pump jack down the pole. Additionally, as the spiral rod wears, it may have a tendency to snap outwardly, thereby further causing additional accidents.

While heretofore pump jacks and pump jack poles were typically utilized to support scaffolding in the installation of aluminum siding, such equipment can actually by utilized in other scaffolding sectors. For example, in industrial or marine use, scaffolding is often required both for internal use and external use. In warehouses, where access to various tiers of stored objects is required, the use of the pump jack and pump jack poles would be convenient. Platform and pallet staging could be raised and lowered in order to reach the desired objects. Similarly, in marine applications, the loading and unloading of ships could use the present pump jack and pump jack pole arrangement to advantage.

While utilizing the pump jack and pump jack pole for industrial use, however, additional strength would be needed for the pump jack in order to support the extra weight of the platforms. Such extra strength is required not only in the construction of the pump jack itself, but in the operative portions thereof, including the shackles, the platform, etc.

Accordingly, while the aforementioned prior art patents have provided improvements in the utilization of pump jacks and pump jack poles, all such systems are dependent on frictional engagement for climbing and for support.

Accordingly, it is a principal object of the present invention to provide an alternative to the use of pump jacks and pump jack poles dependant on friction for supporting scaffolding equipment.

Another object of the present invention is the provision of an improved primary pole jack having a positive interlock system to prevent accidental disengagement or slipping of the jack on the pole.

Still another object of the present invention is the provision of an improved jack which includes a simple directional selector arrangement for lowering the pole jack down the jack pole.

And a further object of the present invention is to provide a pole jack having an independent secondary locking system to engage the pole in the event of failure of the primary mechanism.

SUMMARY OF THE INVENTION

Briefly, in accordance with the present invention, there is provided a pole jack arranged for travelling up and down a pole. The pole jack includes a frame member, with upper and lower engagement mechanisms supported on the frame member. A pump lever is pivotally coupled to the frame member for causing a pair of upper and lower engagement mechanisms to alternately engage the pole. The non-engaging mechanism is stepped upwardly along the pole while the other mechanism engages the pole. A support arm projects from the pole for holding a weight such as a scaffold platform. A spring loaded selector is provided for alternately disengaging the one mechanism from the pole while ensuring that the other engages the pole. A button on the top of the jack is depressed to release a secondary engagement during descent.

In an embodiment of the invention, the upper and lower mechanisms are each comprised of a horizontal pin mounted within two lugs and arranged with a spring to move the pin into engagement with an extended lip or flange on the pole which contains a series of equipspaced climbing holes. A linkage bracket is also provided so that the lower mechanism is coupled to the pump arm.

The two engagement pins are able to move horizontally but are prevented from rotating by means of horizontal spring pins that engage a horizontal slot adjacent to each pin. The engagement end of the pin is inclined to provide a ramp effect so that the pin automatically disengages the climbing holes when moved in the up direction. The rear of each pin is angled to provide a vertical ramp profile that engages a vertical interlock member when the pin moves into the disengaged position. The rear ramp profiles on the upper and lower pin are opposite to one another so that engagement with the interlock element by one pin causes the interlock element to move into a blocking position with the other pin. This feature prevents both pins from disengaging the pole at the same time.

A separate spring-biased dog brake device is fitted within the operating mechanism. This dog device automatically engages the climbing holes and must be held in the released position by depressing a release button during descent.

In its broad aspect, the pole jack of the invention for climbing and descending a pole having a plurality of vertically equispaced holes formed therein comprises a frame member, upper and lower engagement mechanisms mounted for horizontal reciprocal travel in said frame member for selectively engaging the holes in the pole, a pump lever pivotally mounted on the frame member and operatively connected to the lower engagement mechanism for causing the upper and lower engagement mechanisms to alternately engage the holes in the pole for climbing the pole or descending the pole, and a vertically aligned interlock member pivotally mounted within the frame member for engaging at least one or other of the engagement mechanisms whereby the engagement mechanism engaging a post hole is blocked from releasing the pole while the other engagement mechanism is stepped up or down the pole by pivoting of the pump lever. Each said engagement mechanism comprises an engagement pin mounted for horizontal reciprocal travel within the frame member, spring means for biasing the engagement pin in a forward extended frame hole engaging position, the upper and the lower engagement pins having oppositely bevelled rear ends, and means for biasing the pivotally mounted, vertically aligned interlock member into a neutral position, said interlock member having a mating bevelled ramp surface opposite each engagement pin bevelled rear end, whereby retracting an engagement pin causes the engagement pin bevelled rear end to engage the interlock mating bevelled ramp surface to pivot the interlock member to block the other interlock pin while in its forward extended post hole engaging position.

The interlock member comprises a vertical bar attached to a cylindrical rod mounted for rotation within the frame member, a pin extending radially from the rod, and a spring secured to the frame member receiving the pin coaxially therein whereby the spring biases the rod and the bar attached thereto to a neutral position.

More particularly, the upper engagement mechanism comprises an engagement pin having a downwardly bevelled front end mounted for horizontal reciprocal travel on the frame member, said engagement pin having a guide pin extending diametrically therethrough with exposed radial ends for anchoring a compression spring concentric with the engagement pin for biasing the engagement pin in a forward extended frame hole engaging position and for guided reciprocal travel of an end of the guide pin in a horizontal slot for preventing rotation of the engagement pin, a slide plate mounted for vertical reciprocal travel within the frame member, means for interconnecting the pump lever to the slide plate, the lower engagement mechanism comprises an engagement pin having a downwardly bevelled front end mounted for horizontal reciprocal travel on the slide plate, said engagement pin having a guide pin extending diametrically therethrough with exposed radial ends for anchoring a compression spring concentric with the engagement pin for biasing the engagement pin in a forward extended frame hole engaging position and for guided reciprocal travel of an end of the guide pin in a horizontal slot formed in the guide plate for preventing rotation of the engagement pin, said upper and lower engagement pins having oppositely outwardly bevelled rear ends, and means for biasing the pivotally mounted, vertically aligned interlock member into a neutral position, said interlock member having a mating bevelled ramp surface opposite each engagement pin bevelled rear end, whereby retracting an engagement pin causes the engagement pin bevelled rear end to engage the interlock mating bevelled ramp surface to pivot the interlock member and to block the other interlock pin in its forward extended post hole engaging position.

The means for connecting the pump lever to the slide plate comprises as downwardly extending lever pivotally connected to the pump lever, an actuating pin extending from the downwardly extending lever to the slide plate, and means for resiliently connecting the actuating pin to the side plate and lifting the slide plate upon upward pivotal movement of the pump lever. The means for resiliently connecting the actuating pin to the slide plate comprises a vertical slot formed in the slide plate, said actuating pin having an extension projecting through the vertical slot for vertical reciprocal travel therein, and a tension spring interconnecting the actuating pin to the slide plate whereby upward movement of the actuating pin lifts the slide plate while compensating for excess lifting resistance.

The pole jack further comprises a ramp guide mounted for vertical reciprocal travel within the frame member, and means for raising and lowering the said ramp guide and locking the ramp guide in a selected position, said ramp guide having a pair of spaced apart ramps selectively actuable upon raising or lowering the ramp guide to engage the upper and lower guide pins upon lowering of the pole jack to alternately disengage the upper and lower engagement pins. A tension spring for connecting the ramp guide to the frame member continuously biases the ramp guide downwardly.

The pole has an elongated flange extending the pole has an elongated flange extending the length of the pole, said flange having a plurality of equispaced holes formed along it length for receiving the upper and lower engagement pins, the frame member has a slot for receiving the pole flange for slidable travel therein, and the frame member has upper and lower brackets attached thereto, each bracket having a roller at a distal end thereof for engaging the pole for lateral support of the frame member on the pole. A pair of pole jacks, each in combination with a pole on which the pole jack is mounted and each spaced apart in proximity to a wall surface, have brace means attached to an upper end of each pole for securing the pole to the wall surface and a scaffold extending between the pole jacks mounted on pole jack support arms extending laterally from the frame member at the base thereof for raising and lowering of the scaffold on the poles.

BRIEF DESCRIPTION OF THE DRAWINGS

The objects of the invention and the manner in which they can be attained will become apparent from the following detailed description, taken in conjunction with the accompanying drawings, in which:

FIG. 5 is a perspective fragmentary view of a portion of the pole;

FIG. 6 is a horizontal section of the pole jack through line 6—6 of FIG. 3;

DESCRIPTION OF THE PREFERRED EMBODIMENT

Figure 1:
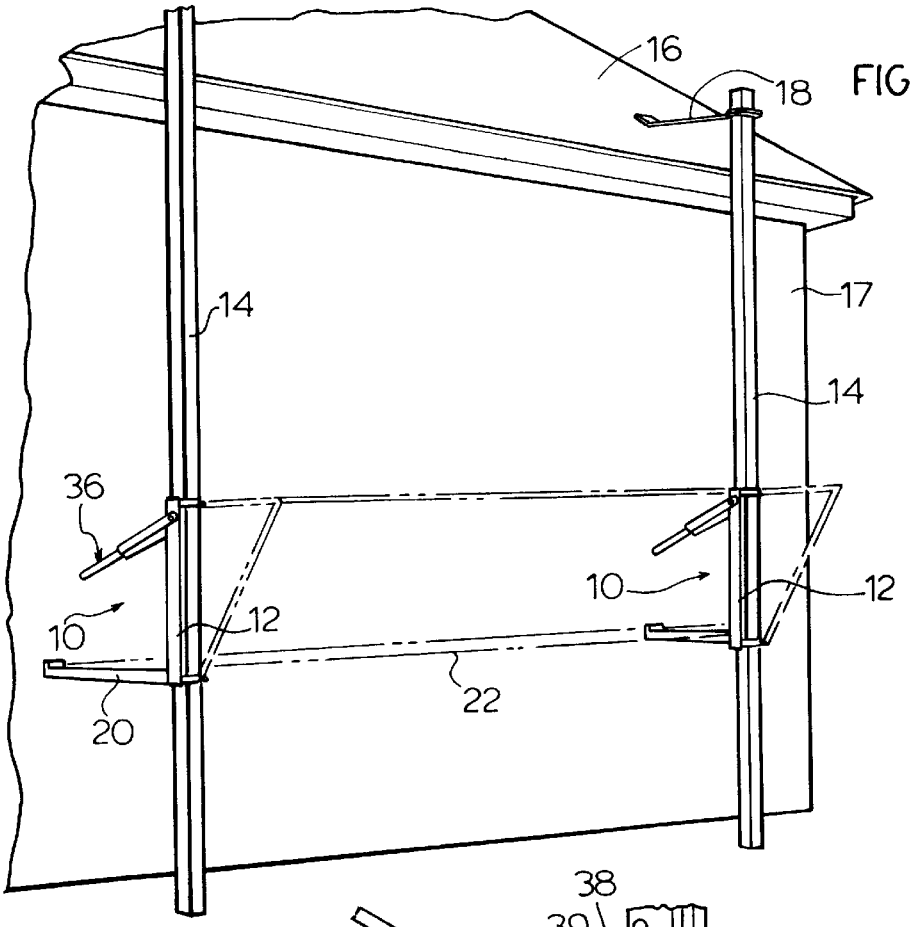
FIG. 1 is a perspective view of pole jacks of the invention supporting a platform.
Figure 2:
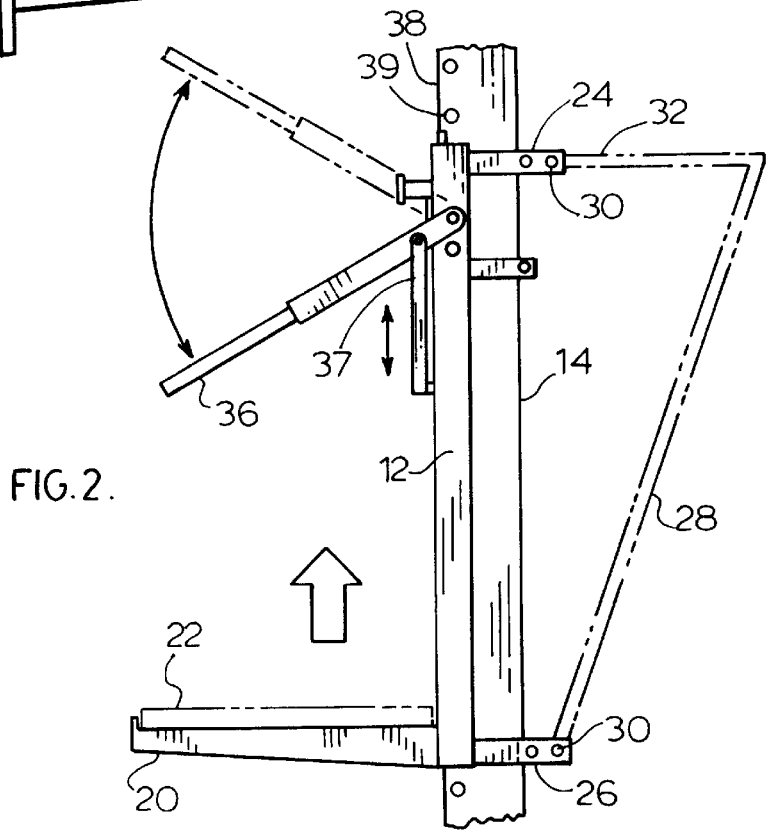
FIG. 2 is a side elevational view of the pole jack shown in FIG. 1.

Referring now to FIGS. 1–5, there is shown a pair of pump jacks, shown generally at 10, each housed in a vertical U-shaped frame 12. Each pump jack 10 is slidably mounted on a jack pole 14 which is seated on a supporting surface, not shown, and attached at its upper distal end to a lateral support such as a roof surface 16 or a wall surface 17 of a building by a brace 18 to ensure lateral stability and safe attachment of each pole. A supporting bracket arm 20, shown projecting laterally from the base of each vertical frame 12, can support a plank 22, shown in ghost lines, to form a scaffold platform. Upper and lower brackets 24, 26 extending outwardly from the opposite of each pump jack frame 12 at each end thereof, can support a work bench bracket 28, shown in ghost lines, secured to brackets 24, 26 by connectors in holes 30. The upper horizontal portion 32 of bracket 28 can support a work bench or a guardrail, not shown.

Figure 3:
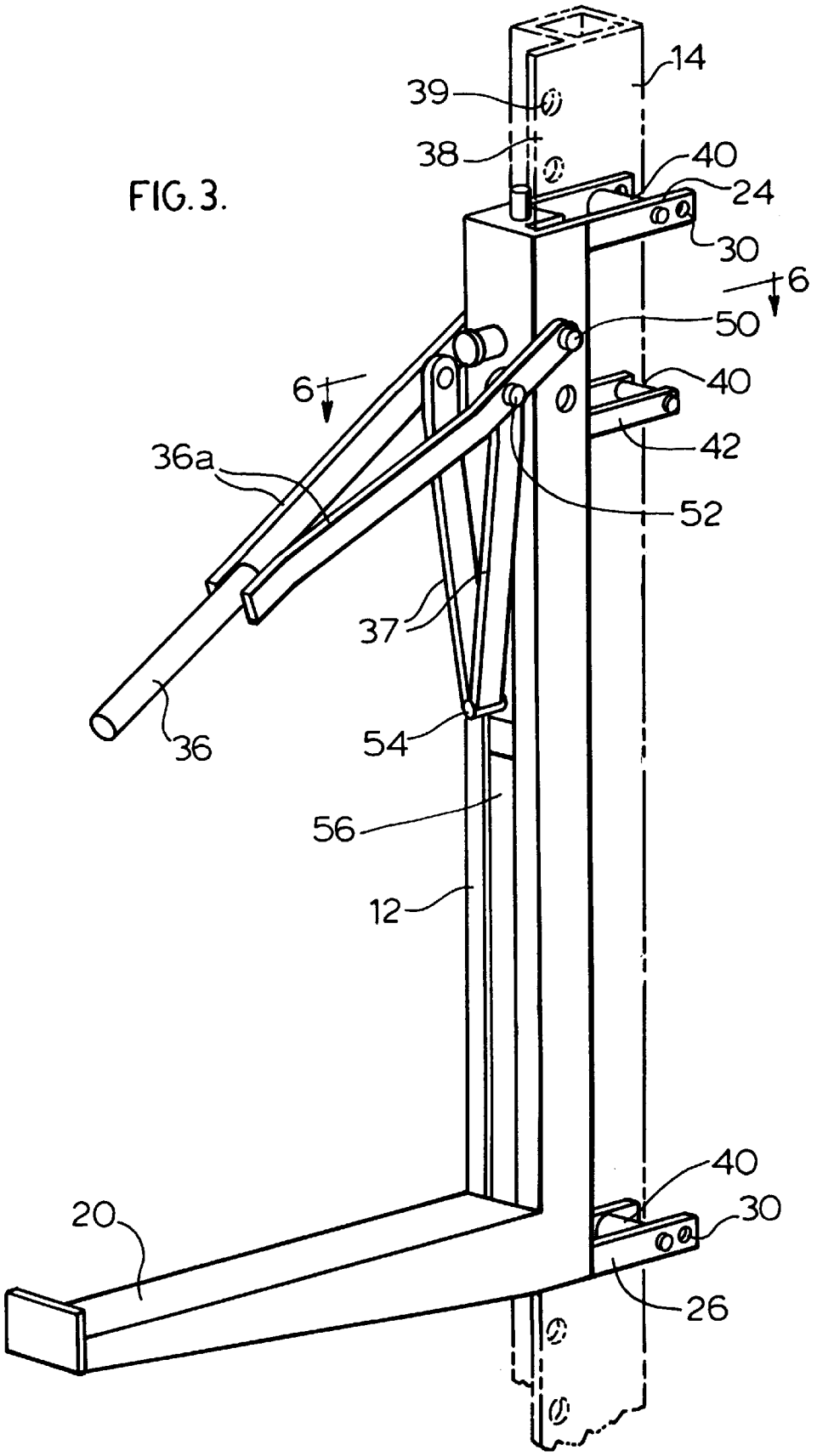
FIG. 3 is an enlarged perspective view of the pole jack shown in FIG. 2.
Figure 4:
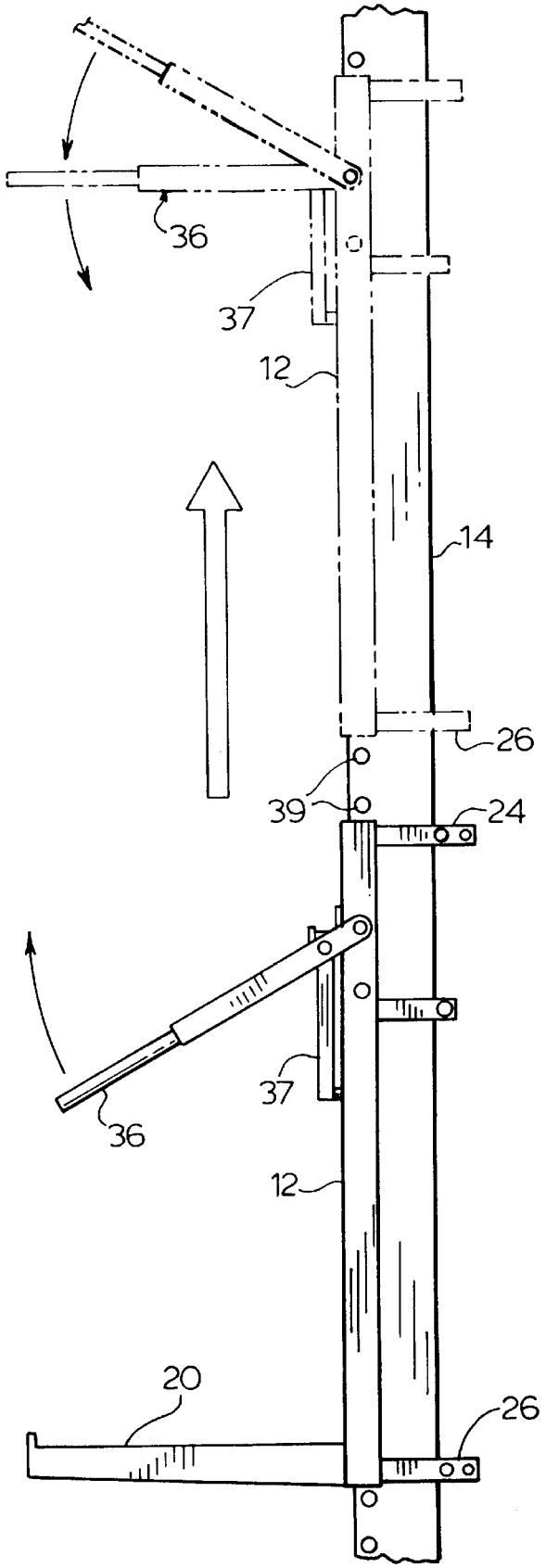
FIG. 4 is a side elevation of the pole jack in two positions on the pole.

Vertical pivotal movement or jacking of pump lever arm 36 and linkages 37 pivotally connected thereto selectively raises or lowers the pump jack up or down post 14, jack frame 12 straddling and sliding vertically along post flange 38 by engagement with flange holes 39, while supported laterally by rollers 40 rotatably mounted in brackets 26, 30 and 42, as shown most clearly in FIG. 3.

Turning now also to FIGS. 6–9, the jack mechanism housed in frame 12 comprises pump lever arm 36 with fork extensions 36*a* straddling and pivotally mounted onto the opposite sides of vertical frame 12 by bolts 50. Downwardly depending linkages 37 are pivotally mounted at one end on lever arm extensions 36*a* by bolts 52. The opposite lower ends of linkages 37 converge and are secured such as by welding to horizontal actuating pin 54 which is mounted for vertical reciprocal travel in central slot 56 of frame 12. Actuating pin 54 extends through vertical slot 58 in slide plate 60 which is mounted for vertically reciprocal guided travel in frame 12 by guide rods 62 welded to opposite sides of frame 12. The extension of pin 54 is operatively connected to slide plate 60 by a tension spring 64, whereby lowering or downward pivoting of lever arm 36 with lower sliding engagement pin 66 biased to the left as viewed in FIG. 8 by compression spring 68 for engagement with pole flange 38 through a flange hole 39, raises frame 12 until upper sliding engagement pin 70 is urged into the next upper hole 39 in flange 38 by compression spring 72, as viewed in FIG. 9. Lower engagement pin 66 is mounted for horizontal slidable travel in aligned apertures in a pair of spaced-apart plates 73, 75 secured such as by welding to plate 60 (FIG. 13). Upper engagement pin 70 is mounted for horizontal slidable travel in aligned apertures in a pair of spaced-apart plates 77, 79 secured such as by welding to plate 81 of frame 12 (FIG. 12).

The operator then raises, i.e. pivots upwardly, lever arm 36 causing lower sliding pin 66 to disengage from the pole flange 38 and move upwardly with upward vertical travel of sliding plate 60 to its next hole-engaging position. Repeating the pivotal lever action results in continued upward vertical travel of the pole jack.

Figure 7:
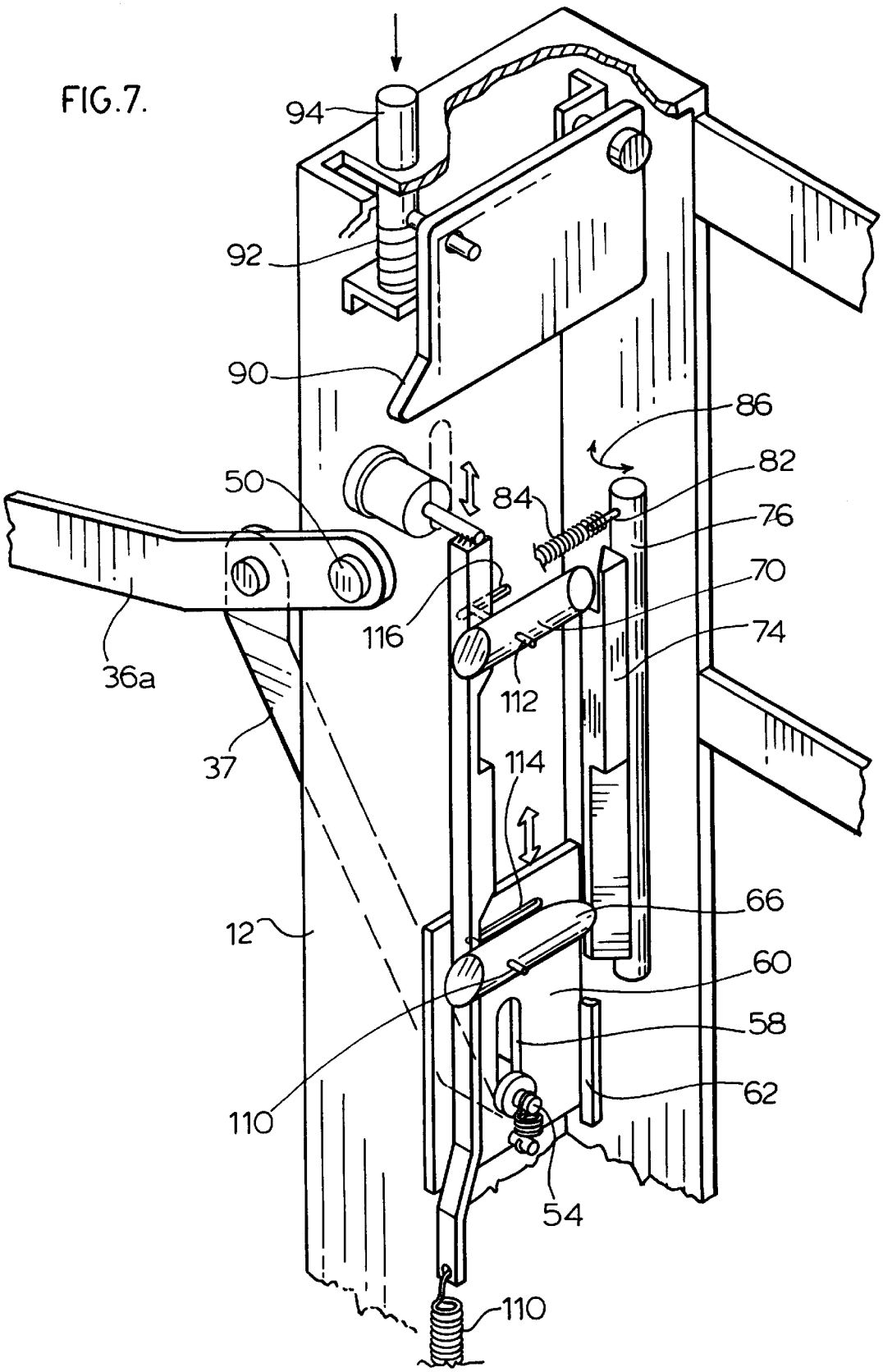
FIG. 7 is a perspective view, partly cut away, of the pole jack mechanism.
Figure 8:
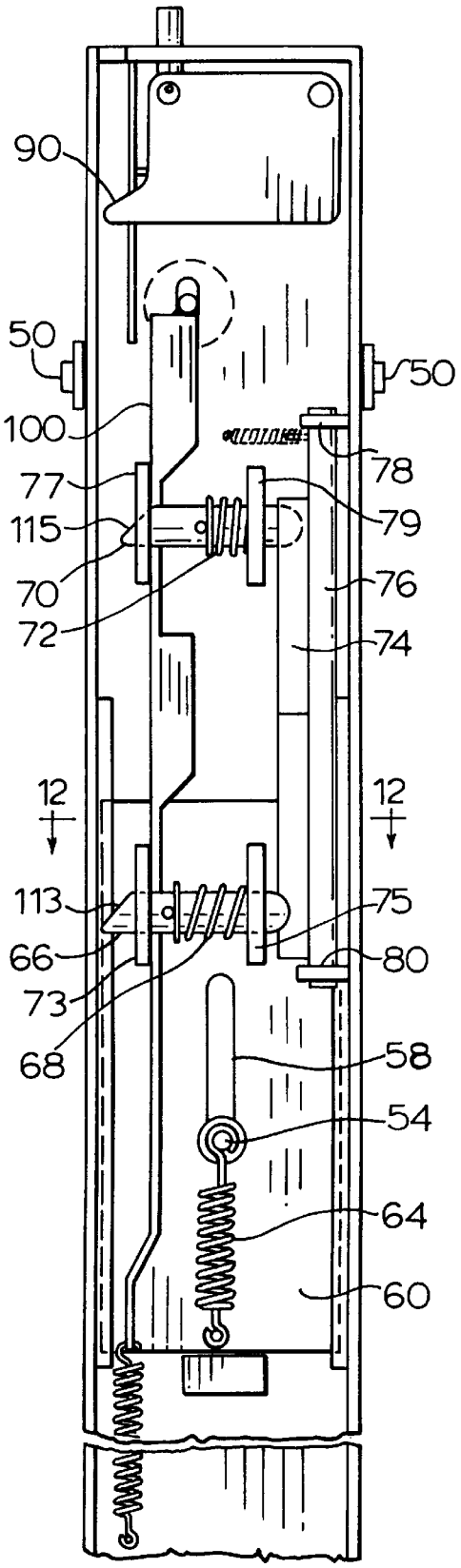
FIG. 8 is a side elevation of the pole jack mechanism illustrated in FIG. 7 in a first operative "up" position.
Figure 9:
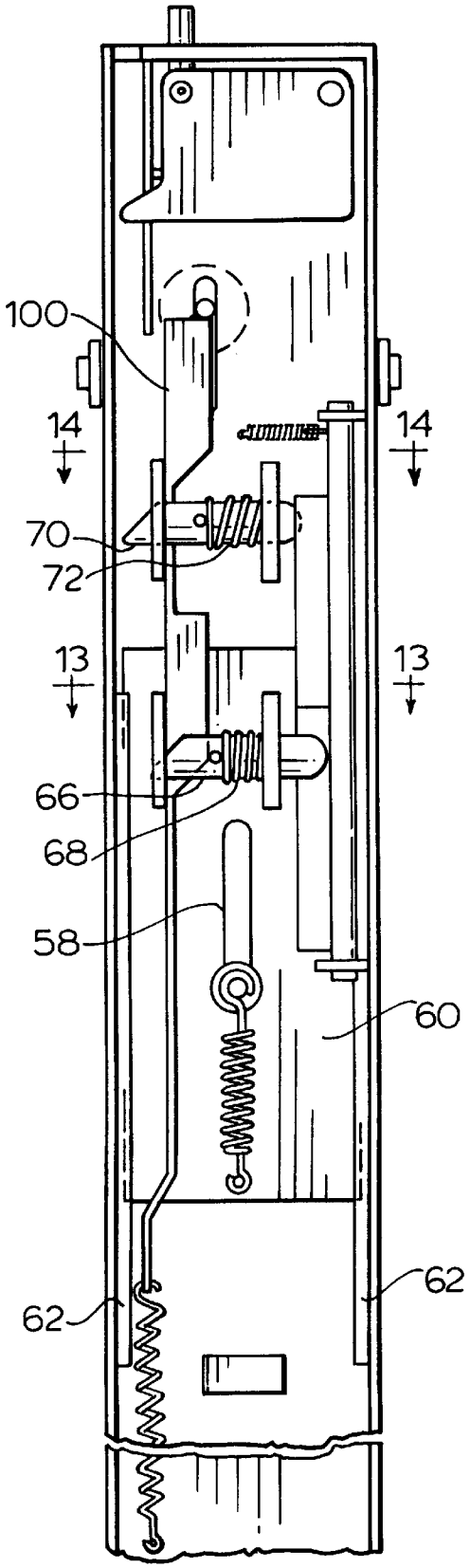
FIG. 9 is a side elevation of the pole jack mechanism shown in FIG. 7 in a second operative "up" position.

With reference to FIGS. 7–9, particularly FIG. 7, vertical interlock bar 74 attached to cylindrical rod 76 is shown rotatably mounted in aligned apertures in upper and lower plates 78, 80 welded to frame 12. Bar 74 is biased into the neutral position typified in FIG. 7 by radial pin 82 extending from rod 76 inserted into spring 84; the interaction of pin 82 with spring 84 tending to bias the bar into the neutral position while allowing the bar to pivot by rotation of rod 76 as depicted by arrow 86.

Figure 12:
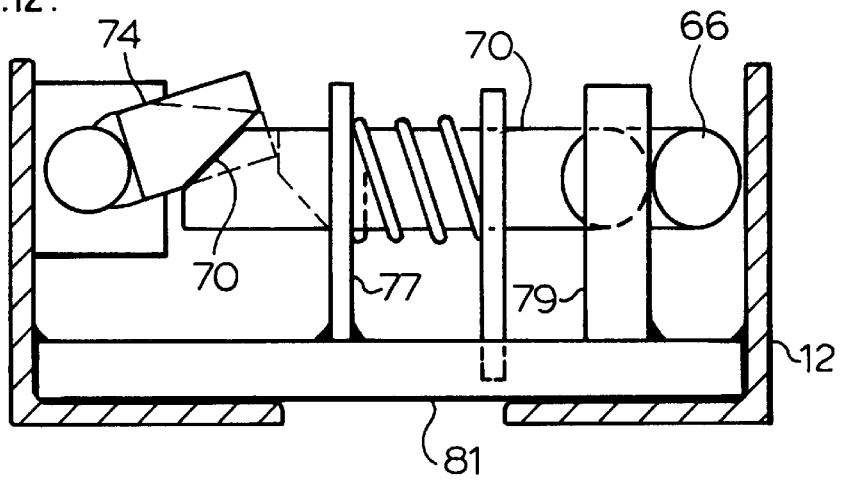
FIG. 12 is a horizontal section taken along line 12—12 of FIG. 8.
Figure 13:
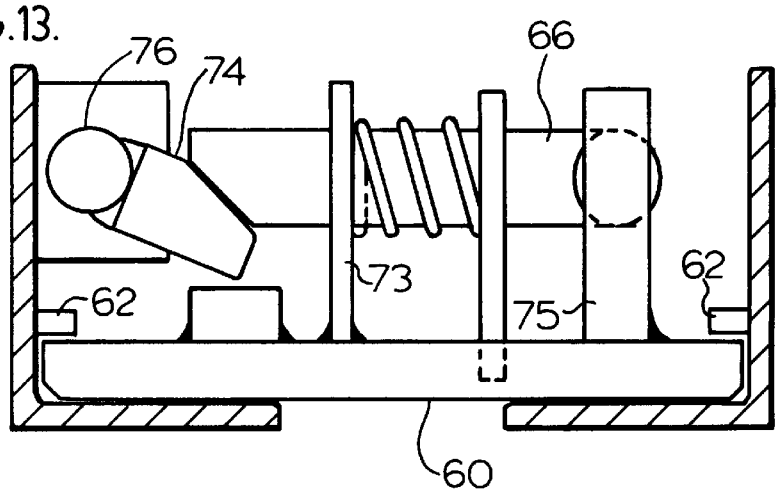
FIG. 13 is a horizontal section taken along line 13—13 of FIG. 9.

Turning to FIGS. 12 and 13, FIG. 12 illustrates upper pin 70 retracted and pin 66 extended into a flange engaging position. The rear end of pin 70 is bevelled as depicted by numeral 90 to engage mating ramp 92 of interlock bar 74 to pivot bar 74 counter-clockwise as viewed in FIG. 12, thereby locking lower pin 66 in its forward flange-engaging position. The retraction of lower pin 66 as viewed in FIG. 13 pivots bar 74 clockwise, thereby blocking upper pin 70 in its forward, flange-engaging position.

Figure 14:
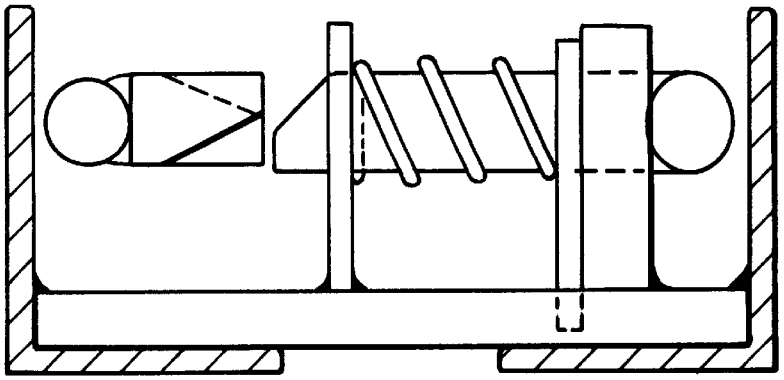
FIG. 14 is a horizontal section taken along line 14—14 of FIG. 9 when both engagement pins are extended.

The blocking of pins 66 and 70 in their respective forward-extended flange-engaging positions ensures that at least one pin will be engaged with flange 38 at all times. The interaction of pin 28 with spring 84 urges bar 74 to pivot to its neutral position as shown in FIGS. 7 and 14 when both engagement pins 66, 70 are in their extended engagement position with flange 38.

There will be occasions during initial engagement between the pole jack 10 and the pole 44 when the upper engagement pin 70 is not aligned with a hole 39 in the pole flange 38 and, as a result, engagement pin 70 is held back and in contact with interlock bar 60 so that continued upward operation of lever 36 could force lower pin 66 out into contact with the interlock bar 74, potentially causing damage to the mechanism. To protect against this, linkage 37 is connected to sliding pin plate 60 by means of a slot 58 and spring 64 which are arranged to provide positive upward transmission of lever force when the lever is lifted up but allow the force to dissipate through spring 64 in the event that excess resistance is encountered.

Figure 15:
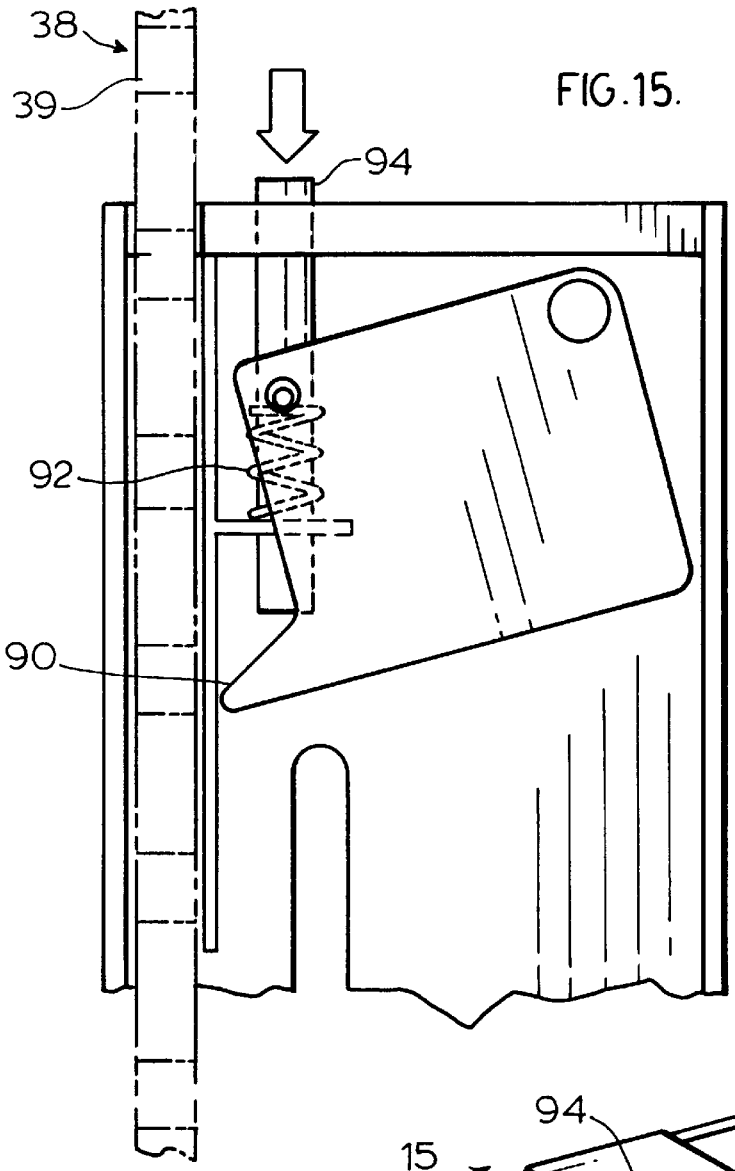
FIG. 15 is a vertical section along line 15—15 of FIG. 16, additionally showing a post flange by ghost lines.
Figure 16:
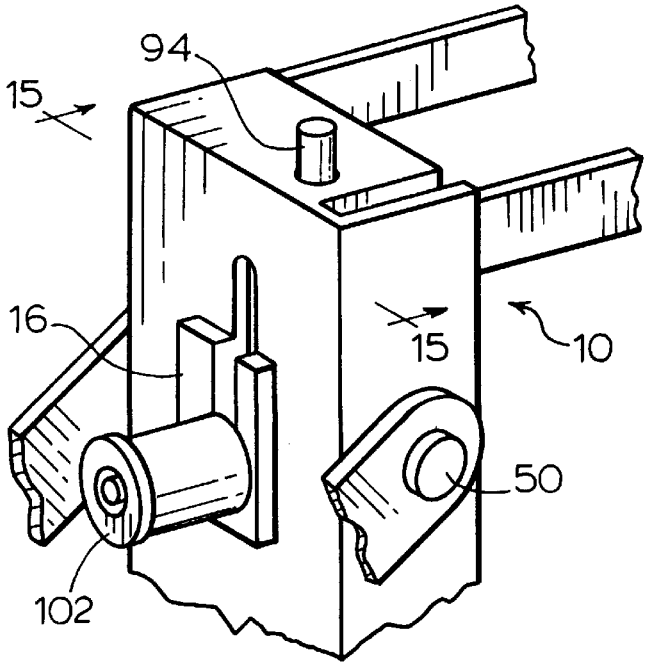
FIG. 16 is a perspective view of the top of jack 10.

As the jack moves up the pole, the pivotally-mounted deadman emergency locking dog 91 functions as a ratchet, engaging and disengaging holes 39 in pole flange 38 in succession (FIG. 15). Compression spring 93 mounted coaxially on release pin 94 maintains positive contact between dog 91 and pole flange 38 during upward travel so that in the event of a failure of the climbing mechanism dog 91 will engage a hole 39 in the flange and arrest the load.

Figure 17:
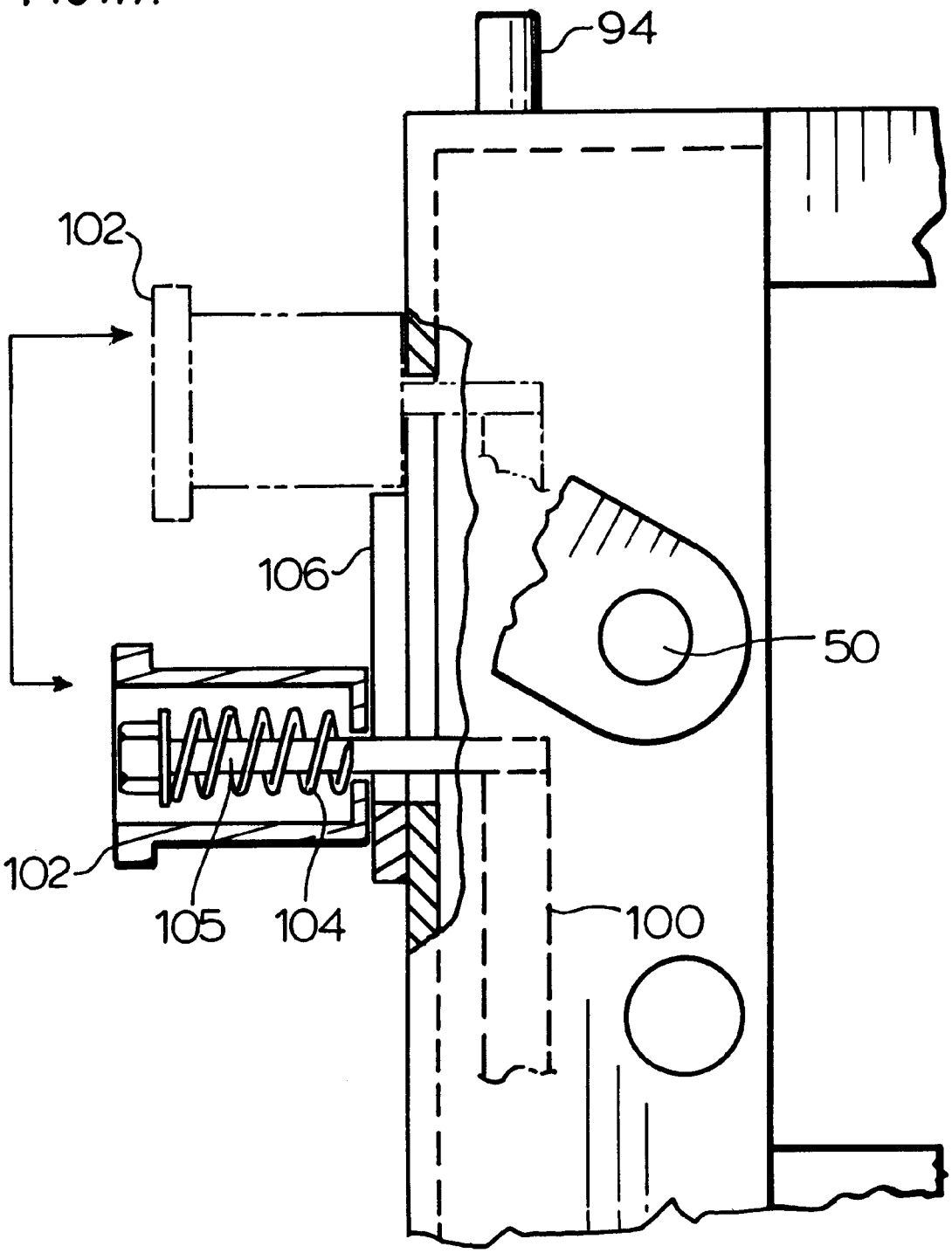
FIG. 17 is a side elevation, partly in section, of the top of jack 10.

In order to return down the pole, vertical ramp guide 100 is moved downwardly from the upper position shown in FIGS. 8 and 9, and by ghost lines in FIG. 17, to the lower position shown in FIGS. 10, 11, 16 and 17. Ramp guide 100 is selectively held in its upper, up-travel position by spring-loaded selector knob 102 which is urged to the right as viewed in FIG. 17 to engage detent 106 by compression spring 104 concentric with rod 105. Extension of knob 102 to the left, again as viewed in FIG. 17, clears detent 106 to allow knob 102 to be moved downwardly and to slide ramp guide 100 connected to knob 102 by rod 105 downwardly. Tension spring 110 secured to ramp guide 100 and to frame 12 biases ramp guide 100 downwardly to maintain ramp guide 100 locked in its downward position.

Figure 10:
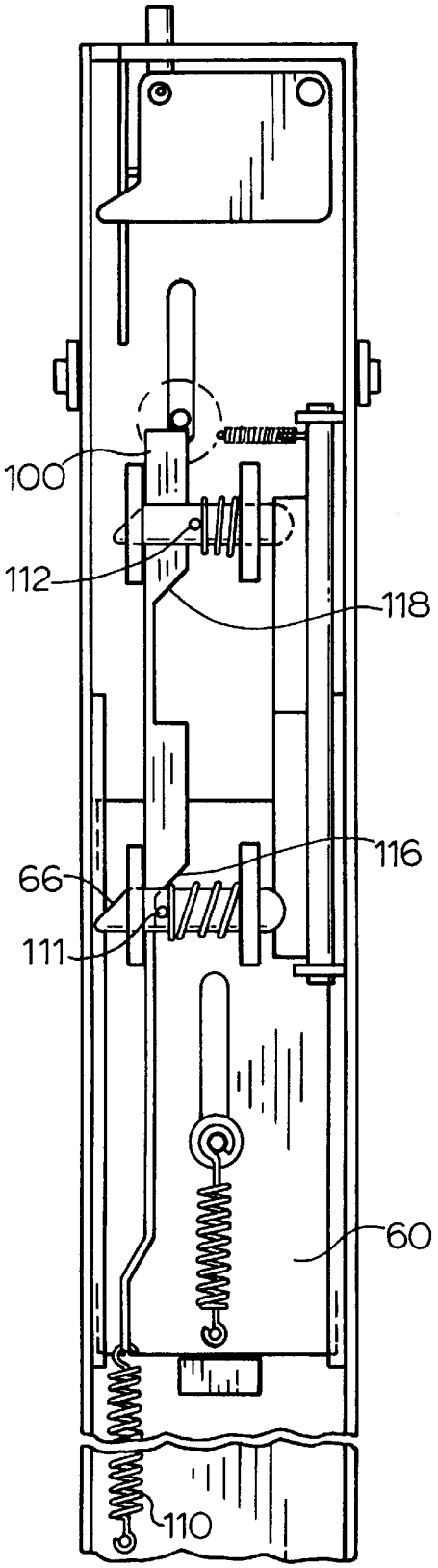
FIG. 10 is a side elevation of the pole jack mechanism shown in FIG. 7 in a first operative "down" position.
Figure 11:
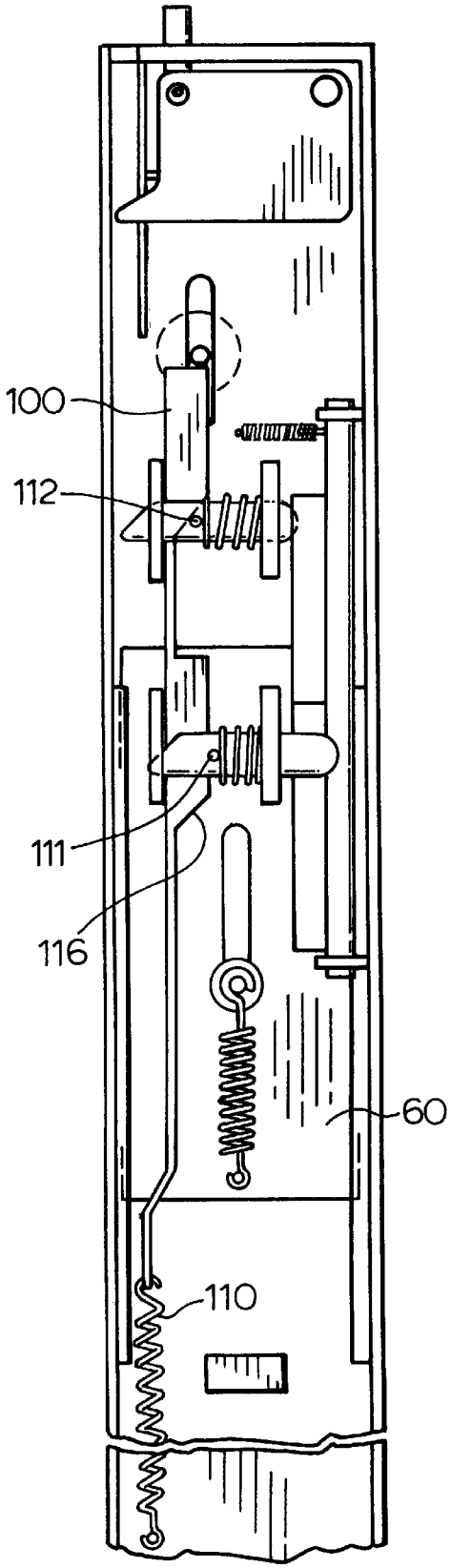
FIG. 11 is a side elevation of the pole jack mechanism shown in FIG. 7 in a second operative "down" position.

Follower guide pins 110, 112 mounted diametrically through lower and upper locking pins 66, 70 respectively have exposed radial ends which slide in horizontal recesses 114, 116 during reciprocal travel of pins 66, 70 to maintain the bevels 113, 115 of pins 66, 70 facing upwardly while engaging and anchoring compression springs 68, 72. During upward travel of the jack 10, follower pins 110, 112 are not deflected by ramp guide 100 as shown in FIGS. 8 and 9. During downward travel of jack 10, however, ramp guide 100 engages follower pins 110, 112, as shown in FIGS. 10 and 11, to alternately disengage engagement pins 66, 70 from pole flange 38. The vertical spacing of ramps 116, 118 allows the vertical load on the jack to be supported by extended lower engagement pin 66 while upper ramp 118 causes upper engagement pin 70 to retract from the pole flange (FIG. 10). As the operator releases the downward pressure on jack lever 36, the jack moves down the pole. When upper engagement pin 70 moves closer to lower engagement pin 66, the lower ramp 116 contacts horizontal engagement pin 66 through follower pin 111 to urge engagement pin to the right, as viewed in FIG. 10. However, since the pin 66 supports the load on the jack, frictional engagement between pin 66 and post flange 38 prevents retraction of engagement pin 66, forcing ramp guide upwardly against the bias of tension spring 110 so that contact between upper ramp 118 and follower pin 112 is removed, as shown in FIG. 11, allowing upper engagement pin 70 to re-engage a hole 39 in pole flange 38 as the pin 70 moves into alignment with the next lower hole position. The operator at this time reverses the pivotal travel of lever 36 so that the jack load shifts to upper engagement pin 70. The lower ramp 116 causes the lower engagement pin 66 to disengage the pole flange, permitting pin 66 to move down the pole to the next lower hole 39. The continued lowering of lever 36 lowers plate 60 whereby lower engagement pin 66 moves below lower ramp 116 and is biased to the left as viewed in FIG. 11 to re-engage the pole flange 38. Repeat of this procedure continues downward travel of the jack.

During downward travel the operator must depress release pin 94, to cause locking dog 91 to be held clear of the pole flange 38. In the event of a mechanical failure resulting in sudden downward movement of the jack, it is expected that the operator will lose contact with release pin 94, thus allowing locking dog 91 to engage the pole flange 38 and arrest the load.

It will be understood that modifications can be made in the embodiment of the invention illustrated and described herein without departing from the scope and purview of the invention as defined by the appended claims.

We claim:

1. A pole jack for climbing and descending a pole having a plurality of vertically equispaced holes formed therein, said pole jack comprising a frame member, upper and lower engagement mechanisms mounted for horizontal reciprocal travel in said frame member for selectively engaging the holes in the pole, a pump lever pivotally mounted on the frame member and operatively connected to the lower engagement mechanism for causing the upper and lower engagement mechanisms to alternately engage the holes in the pole for climbing the pole or descending the pole, and a vertically aligned interlock member pivotally mounted within the frame member for engaging at least one or other of the engagement mechanisms whereby the engagement mechanism engaging a post hole is blocked from releasing the pole while the other engagement mechanism is stepped up or down the pole by pivoting of the pump lever.

2. A pole jack as claimed in claim 1 wherein each said engagement mechanism comprises an engagement pin mounted for horizontal reciprocal travel within the frame member, spring means for biasing the engagement pin in a forward extended frame hole engaging position, the upper and the lower engagement pins having oppositely bevelled rear ends, means for biasing the pivotally mounted, vertically aligned interlock member into a neutral position, said interlock member having a mating bevelled ramp surface opposite each engagement pin bevelled rear end, whereby retracting an engagement pin causes the engagement pin bevelled rear end to engage the interlock mating bevelled ramp surface to pivot the interlock member and to block the other interlock pin while in its forward extended post hole engaging position.

3. A pole jack as claimed in claim 2 wherein the interlock member comprises a vertical bar attached to a cylindrical rod mounted for rotation within the frame member, a pin extending radially from the rod, and a spring secured to the frame member receiving the pin coaxially therein whereby the spring biases the rod and the bar attached thereto to a neutral position.

4. A pole jack as claimed in claim 1 wherein the upper engagement mechanism comprises an engagement pin having a downwardly bevelled front end mounted for horizontal reciprocal travel on the frame member, said engagement pin having a guide pin extending diametrically there through with exposed radial ends for anchoring a compression spring concentric with the engagement pin for biasing the engagement pin in a forward extended frame hole engaging position and for guided reciprocal travel of an end of the guide pin in a horizontal slot for preventing rotation of the engagement pin, a slide plate mounted for vertical reciprocal travel within the frame member, means for interconnecting the pump lever to the slide plate, the lower engagement mechanism comprises an engagement pin having a downwardly bevelled front end mounted for horizontal reciprocal travel on the slide plate, said engagement pin having a guide pin extending diametrically there through with exposed radial ends for anchoring a compression spring concentric with the engagement pin for biasing the engagement pin in a forward extended frame hole engaging position and for guided reciprocal travel of an end of the guide pin in a horizontal slot formed in the guide plate for preventing rotation of the engagement pin, said upper and lower engagement pins having oppositely outwardly bevelled rear ends, and means for biasing the pivotally mounted, vertically aligned interlock member into a neutral position, said interlock member having a mating bevelled ramp surface opposite each engagement pin bevelled rear end, whereby retracting an engagement pin causes the engagement pin bevelled rear end to engage the interlock mating bevelled ramp surface to pivot the interlock member and to block the other interlock pin in its forward extended post hole engaging position.

5. A pole jack as claimed in claim 4 wherein the means for connecting the pump lever to the slide plate comprises a downwardly extending lever pivotally connected to the pump lever, an actuating pin extending from the downwardly extending lever to the slide plate, means for resiliently connecting the actuating pin to the side plate and lifting the slide plate upon upward pivotal movement of the pump lever.

6. A pole jack as claimed in claim 4 wherein the means for resiliently connecting the actuating pin to the slide plate comprises a vertical slot formed in the slide plate, said actuating pin having an extension projecting through the vertical slot for vertical reciprocal travel therein, and a tension spring interconnecting the actuating pin to the slide plate whereby upward movement of the actuating pin lifts the slide plate while compensating for excess lifting resistance.

7. A pole jack as claimed in claim 6 further comprising a ramp guide mounted for vertical reciprocal travel within the frame member, means for raising and lowering the said ramp guide and locking the ramp guide in a selected position, said ramp guide having a pair of spaced apart ramps selectively actuable upon raising or lowering the ramp guide to engage the upper and lower guide pins upon lowering of the pole jack to alternately disengage the upper and lower engagement pins.

8. A pole jack as claimed in claim 7, a tension spring for connecting the ramp guide to the frame member for continuously biasing the ramp guide downwardly.

9. A pole jack as claimed in claim 7 wherein the pole has an elongated frame extending the length of the pole, said flange having a plurality of equispaced holes formed along it length for receiving the upper and lower engagement pins, wherein the frame member has a slot for receiving the pole flange for slidable travel therein, and wherein the frame member has upper and lower brackets attached thereto, each bracket having a roller at a distal end thereof for engaging the pole for lateral support of the frame member on the pole.

10. A pole jack as claimed in claim 9 wherein the frame member has a base, additionally comprising a support arm for scaffolding extending laterally from the frame member at the base thereof opposite the lower bracket.

11. A pair of pole jacks as claimed in claim 10 each in combination with a pole on which the pole jack is mounted and each spaced apart in proximity to a wall surface, brace means attached to an upper end of each pole for securing the pole to the wall surface, and a scaffold extending between the pole jacks mounted on the pole jack support arms for raising and lowering of the scaffold on the poles.

* * * * *